US012146383B2

(12) United States Patent
Shaarawi et al.

(10) Patent No.: US 12,146,383 B2
(45) Date of Patent: Nov. 19, 2024

(54) SYSTEM AND METHOD FOR RUNNING AND CEMENTING FABRIC-NESTED CASING

(71) Applicant: SAUDI ARABIAN OIL COMPANY, Dhahran (SA)

(72) Inventors: Amjad Shaarawi, Khobar (SA); Mohammad Aljubran, Sayhat (SA); Mohammed Alsheikh, Dammam (SA); Abdulwahab Aljohar, Dhahran (SA); Timothy Eric Moellendick, Dhahran (SA); Ossama Sehsah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 191 days.

(21) Appl. No.: 17/852,094

(22) Filed: Jun. 28, 2022

(65) Prior Publication Data

US 2023/0417122 A1 Dec. 28, 2023

(51) Int. Cl.
*E21B 33/14* (2006.01)
*E21B 3/04* (2006.01)

(52) U.S. Cl.
CPC ..... *E21B 33/14* (2013.01); *E21B 3/04* (2013.01)

(58) Field of Classification Search
CPC ..... E21B 33/00
See application file for complete search history.

(56) References Cited

U.S. PATENT DOCUMENTS 1,641,035 A * 8/1927 Hero ..... E21B 33/138 166/387
3,272,517 A * 9/1966 Howard ..... E21B 33/1208 277/333
3,385,367 A * 5/1968 Kollsman ..... E21B 33/134 166/387
5,235,794 A 8/1993 Center
2007/0053749 A1 3/2007 Jarvis et al.

FOREIGN PATENT DOCUMENTS

JP H05-51922 A 3/1993

* cited by examiner

*Primary Examiner* — William D Hutton, Jr.
*Assistant Examiner* — Avi T Skaist
(74) *Attorney, Agent, or Firm* — Osha Bergman Watanabe Burton LLP

(57) ABSTRACT

A rig site may include a rotary table within a rig floor above a wellbore. A fabric sheet rolled into two symmetrical rolls is disposed on the rig floor. A pre-cut center hole of the fabric sheet is coaxial with the rotary table. A casing string, to be lowered in the wellbore, includes a first casing joint at a bottom of the casing string is a modified float joint. The pre-cut center hole of the fabric sheet is attached to a sleeve of the modified float joint. Union units are provided above the rotary table. The union units close the fabric sheet around the casing string to form a fabric-nested casing string within the wellbore. A cement slurry is pumped down the casing string and into a space between the fabric sheet and the casing string to cement the fabric-nested casing string to the wellbore.

20 Claims, 10 Drawing Sheets

SYSTEM AND METHOD FOR RUNNING AND CEMENTING FABRIC-NESTED CASING

BACKGROUND

A completed well 1, as illustrated in FIG. 1, includes a casing profile 2 within a wellbore 3 extending from a surface 4 into subterranean formations 5. In general, there may be many layers of subterranean formations 5 below the surface 4. The casing profile 2 includes multiple casing strings, such as a conductor casing 6, a surface casing 7, an intermediate casing 8, and a production casing 9. The conductor casing 6 may be a large-diameter casing that protects shallow formations from contamination by drilling fluid and helps prevent washouts involving unconsolidated topsoils and sediments. The surface casing 7, the second string, has a smaller diameter than the conductor casing 6, maintains borehole integrity and prevents contamination of shallow groundwater by hydrocarbons, subterranean brines and drilling fluids. The intermediate casing 8, the third string, has a smaller diameter than the surface casing 7, isolates hydrocarbon-bearing, abnormally pressured, fractured and lost circulation zones, providing well control as engineers drill deeper. Multiple strings of the intermediate casing 8 may be required to reach the target producing zone. The production casing 9, or liner, is the last and smallest tubular element in the completed well 1. The production casing 9 isolates the zones above and within the production zone and withstands all of the anticipated loads throughout the well's life. Additionally, the production casing 9 may be perforated 10 to allow hydrocarbons to flow into the production casing 9.

Furthermore, each casing string 6-9 undergoes a cement operation. Typically, a well section is drilled; then a casing string (e.g., the conductor casing 6, the surface casing 7, the intermediate casing 8, or the production casing 9) is lowered into the wellbore 3 and then cemented with a cement slurry 11. The cement slurry 11 is a combination of cement, cement additives, and water. In FIGS. 2A-2C, a cement operation is illustrated. For example purposes, a first casing string 13 is shown as cemented in with a first cement slurry 11*a*. With the first casing string 13 cemented, a new well section 12 is drilled. Once the new well section 12 has reached a required depth, a second casing string 14 is lowered and run through the new well section 12. Next, a second cement slurry 11*b* is pumped into the new well section 12 down through the second casing string 14 and into an annulus around the second casing string 14 or in the open hole below the second casing string 14. However, there are cases where the cement operation fails due to the loss-of-circulation as demonstrated in FIG. 3. In such cases, rather than filling the entire area behind the second casing string 14, the second cement slurry 11*b* is lost in a loss-of-circulation zone 15. The loss-of-circulation zone 15 forms an un-isolated open-hole 16 in an area above, jeopardizing the integrity of the well.

Conventionally, to mitigate the occurrence of the un-isolated open-hole 16 and loss of the second cement slurry 11*b*, a drilling crew may try to cure the loss-of-circulation zone 15 before pulling out of hole. This is done by pumping LCM (loss-of-circulation material) or cement plugs. However, such practices are not guaranteed to succeed. Moreover, cement is typically heavier than the drilling fluid. As a result, even if losses are cured during the drilling phase, cement might induce losses again during the cementing phase due to the higher hydrostatic pressure exerted on the well. Another measure may be to use low-density cement in order to avoid fracturing the formation. However, low-density cement also has limitations and is not applicable in all scenarios.

Another conventional method to mitigate the occurrence of the un-isolated open-hole and loss of the cement slurry, a multi-stage cementing tool may be used. The multi-stage cementing tool may be installed at various depths along the casing string, may be used to introduce the second cement slurry directly into the annulus along a length of the casing string. For example, the multi-stage cementing tool may be placed in the casing string, above the loss-of-circulation zone 15 and a packer of the multi-stage cementing tool may seal the annulus above the loss-of-circulation zone 15.

A first stage cement is pumped until the cement slurry reaches the multi-stage cementing tool. The multi-stage cementing tool is then activated to open ports for a second stage cement. This enables pumping the cement slurry through the multi-stage cementing tool, and only above the packer of the multi-stage cementing tool. The cement slurry supports and protects well casings and helps achieve zonal isolation while protecting the surrounding environment. Additionally, the cement slurry is supported from the bottom by the packer of the stage cementing differential valve tool, and not by cement from the bottom. This way, even if the cement slurry is lost below the multi-stage cementing tool, the cement slurry will still hold above providing some level of well integrity. However, multi-stage cementing tools may have also fail during the job or after execution leading to potential long term sustained casing pressure as well as an inability to fix annular pressure issues. Additionally, multi-stage cementing tools have the issue of an un-cemented area under the packer.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a rig site. The rig site may include a rotary table within a rig floor above a wellbore; a fabric sheet rolled into two symmetrical rolls disposed on the rig floor, a pre-cut center hole of the fabric sheet is coaxial with the rotary table; casing joints made-up end-to-end together at the rig floor via the rotary table to form a casing string to be lowered in the wellbore, a first casing joint at a bottom of the casing string is a modified float joint, the pre-cut center hole of the fabric sheet is attached to a sleeve of the modified float joint; and one or more union units provided above the rotary table, the one or more union units is configured to close the fabric sheet around the casing string to form a fabric-nested casing string within the wellbore. Additionally, a cement slurry is configured to be pumped down the casing string and into a space between the fabric sheet and the casing string to cement fabric-nested casing string to the wellbore.

In another aspect, embodiments disclosed herein relate to a well system. The well system may include a first casing string extending a first depth within a wellbore, the first casing string includes a first plurality of casing joints joined end-to-end; a first cement slurry configured to cement the first casing string within the wellbore; a second casing string extending a second depth within a wellbore, the second casing string includes a second plurality of casing joints joined end-to-end, wherein the second depth is deeper than the first depth; a fabric sheet nesting a length of the second casing string; and a second cement slurry provided in a space between the fabric sheet and the length of the second casing string configured to inflate the fabric sheet against the wellbore and cement the length of the second casing string within the wellbore.

In yet another aspect, embodiments disclosed herein relate to a method. The method may include attaching a pre-cut center hole of a fabric sheet to a sleeve on a modified float joint of a casing string; lowering the casing string into a wellbore; closing, with a union unit, the fabric sheet around the casing string as the casing string is being lowered into the wellbore to form a fabric-nested casing string; cutting the fabric sheet based on a length of the casing string to be nested by the fabric sheet distal to the modified float joint; performing cementing operations when the casing string reaches a bottom of the wellbore; pumping a first plug down the casing string ahead of a cement slurry to land within the modified float joint; increasing a pressure within the modified float joint by continuously pumping the cement slurry; opening one or more side ports of the modified float joint when the pressure reached a threshold; and inflating the fabric sheet with the cement slurry by flowing the cement slurry through the one or more side ports into a space between the fabric sheet and the modified float joint, the fabric sheet is inflated against the wellbore to cement the casing string.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

FIGS. 10A-10C are schematic diagrams of a completion well system according to one or more embodiments of the present disclosure.

DETAILED DESCRIPTION

Figure 1:
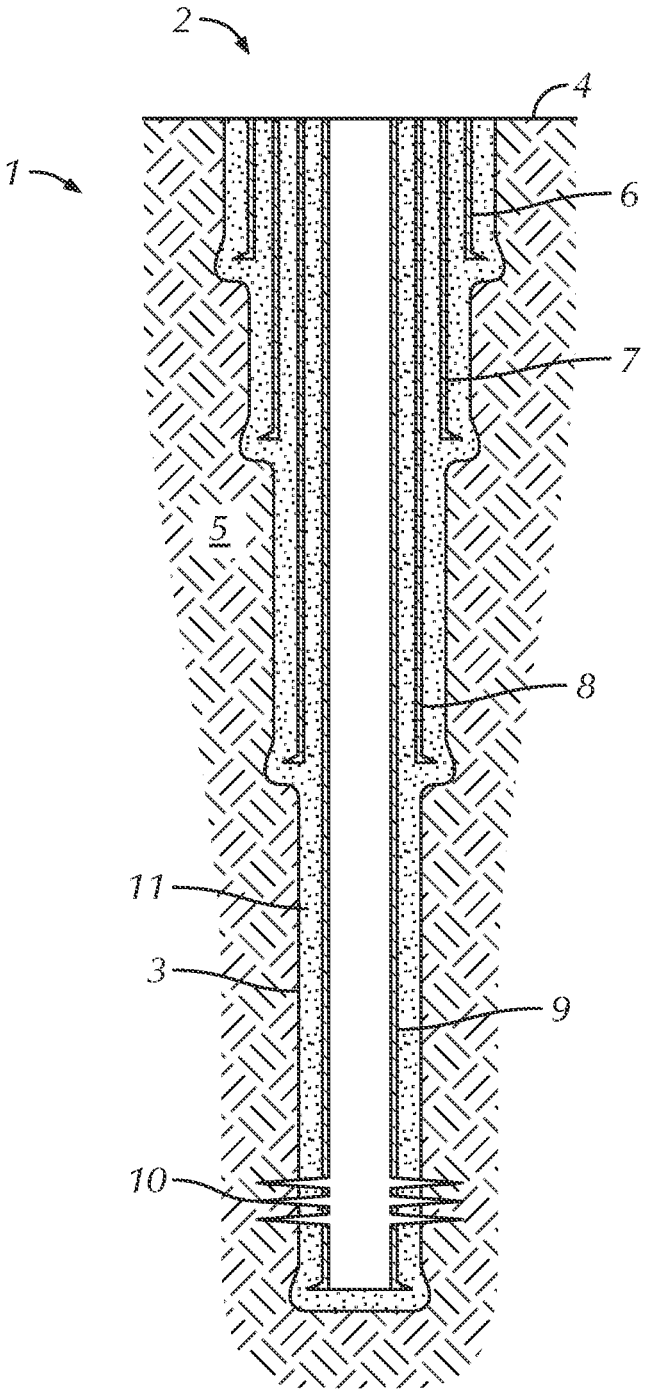
FIG. 1 (Prior Art)
FIGS. 1-3 are schematic diagrams of a completion well system in accordance with prior art.
Figure 2A:
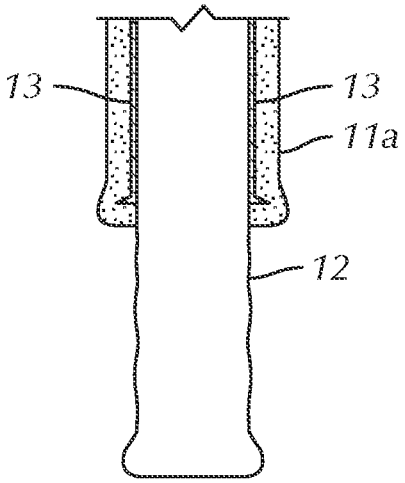
FIG. 2A (Prior Art)
Figure 2B:
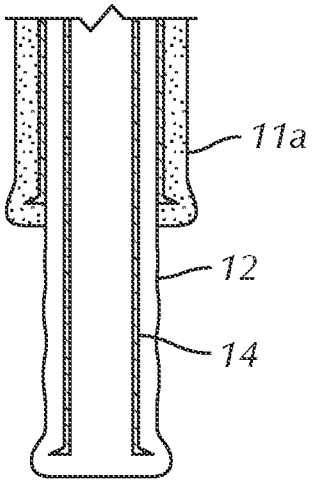
FIG. 2B (Prior Art)
Figure 2C:
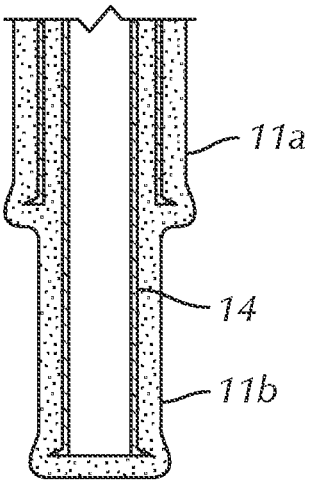
FIG. 2C (Prior Art)
Figure 3:
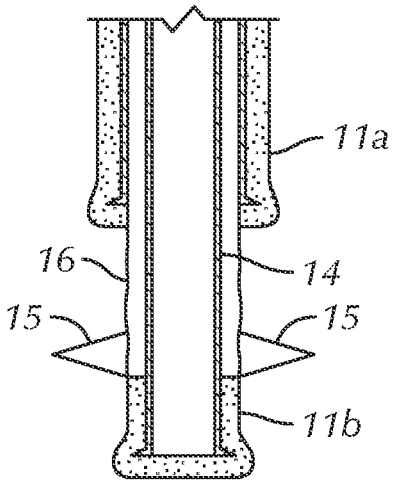
FIG. 3 (Prior Art)

Embodiments of the present disclosure are described below in detail with reference to the accompanying figures. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures. As used herein, the term "coupled" or "coupled to" or "connected" or "connected to" "attached" or "attached to" may indicate establishing either a direct or indirect connection, and is not limited to either unless expressly referenced as such.

Embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in other environments, such as land or sub-sea, without departing from the scope of the present disclosure. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure. The embodiments are described merely as examples of useful applications, which are not limited to any specific details of the embodiments herein.

Further, embodiments disclosed herein are described with terms designating in reference to a tubular, but any terms designating should not be deemed to limit the scope of the disclosure. For example, the tubular string is made up of numerous tubular pipes joined end-to-end, and each of the tubular pipes might be about twenty to forty feet in length. Further, the tubular pipes are hollow and thus provide a continuous channel of communication between the surface and the bottom of the wellbore, down through which a suitable fluid can be introduced to any region required within the well. It is to be further understood that the various embodiments described herein may be used with various types of tubulars, including but not limited to casing or liners, without departing from the scope of the present disclosure. A casing generally refers to a large-diameter pipe that is lowered into an open-hole and cemented in place. As used herein, cement slurry may refer to a fluid made from a mixture of cement, cement additives and water.

In one or more embodiments, the present disclosure may be directed to systems and methods for using a fabric to contain cement in a wellbore and prevent cement loss in fractures. More specifically, embodiments disclosed herein are directed to a fabric sheet rolled into symmetric rolls for surrounding all or a portion of a casing string to form a fabric-nested casing string. For example, the casing string connects to a pre-cut hole in a center of the fabric sheet and the fabric sheet wraps around the casing string. Additionally, the fabric sheet is closed around the casing string with a union unit on a rig floor to form the fabric-nested casing string being lowered into the wellbore. Further, a modified float joint may be run-in-hole at the center of the fabric sheet where the casing string is connected. For example, the fabric sheet is connected to a sleeve of the modified float joint. In some embodiments, the modified float joint is plugged at a bottom and side ports of the modified float joint are opened to allow a cement slurry to flow into an annulus between the fabric sheet and the casing string. The one or more embodiments of a method of using the fabric wrapped casing results in containing cement in the open-hole and preventing cement loss in fractures, improved cement slurry displacement and circulation within an annulus, minimized cement slurry loss in the wellbore, and reduction in operational costs associated with remedial follow-up cementing operations resulting from loss-of-circulation.

Figure 4:
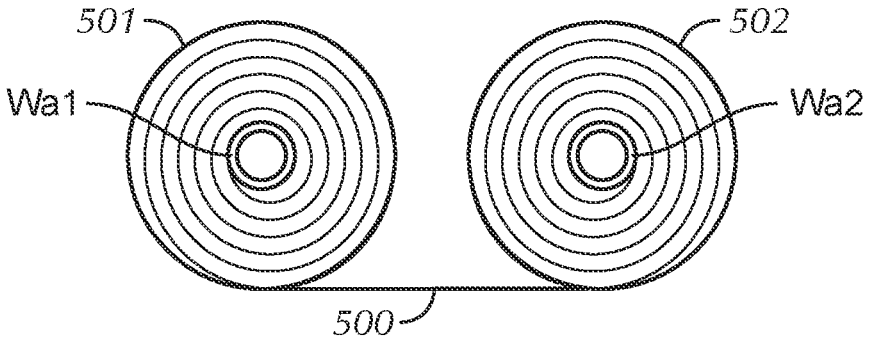
FIG. 4 is a schematic diagram of a fabric sheet according to one or more embodiments of the present disclosure.

As shown in FIG. 4, in one or more embodiments, a fabric sheet 500 is rolled about a first width axis Wa1 and a second width axis Wa2 to form two symmetrical fabric rolls 501, 502. The fabric sheet 500 may have various properties to withstand a downhole environment. For example, the fabric sheet 500 may have the following properties a strength to withstand the burst pressure resulting from the hydrostatic column of the cement, a wear-resistant to maintain integrity while run-in-hole (RIH) and friction forces between the casing string and the wellbore, maintaining mechanical properties at downhole temperature at least until the cement slurry is solid, compatible with (inert to) the cement slurry (and, if applicable, to H2S), and be elastic and flexible enough to take a required shape downhole. In some embodiments, the fabric sheet 500 may made from a material such as, but not limited to, Kevlar, ultra-high-molecular-weight polyethylene, Vectran, or synthetic rubbers, or a combination thereof.

In some embodiments, for example, the fabric sheet 500 is a rectangular or square sheet with dimensions expressed using the following equations:

$$\text{Length}=2L+\delta_L \qquad \text{Equation 1}$$

Where L is the overall length that needs to be nested, and δL is an additional tolerance added to take "imperfections", corrugations, and micro doglegs into account.

$$\text{Width}=\pi D_h+\delta_H \qquad \text{Equation 2}$$

$D_h$ is the diameter of the hole that needs to be covered, and $\delta_H$ is an additional tolerance added to take into account "imperfections", corrugations, the distance that the fabric needs to penetrate into fractures, and the distance to be consumed on each side in the "union" process to be explained later.

In one or more embodiments, a thickness of the fabric sheet 500 is based on a strength needed to withstand differential pressures to avoid bursting. For example, the thicker the fabric sheet 500 is, the higher differential pressures the fabric sheet 500 can withstand.

Figure 5A:
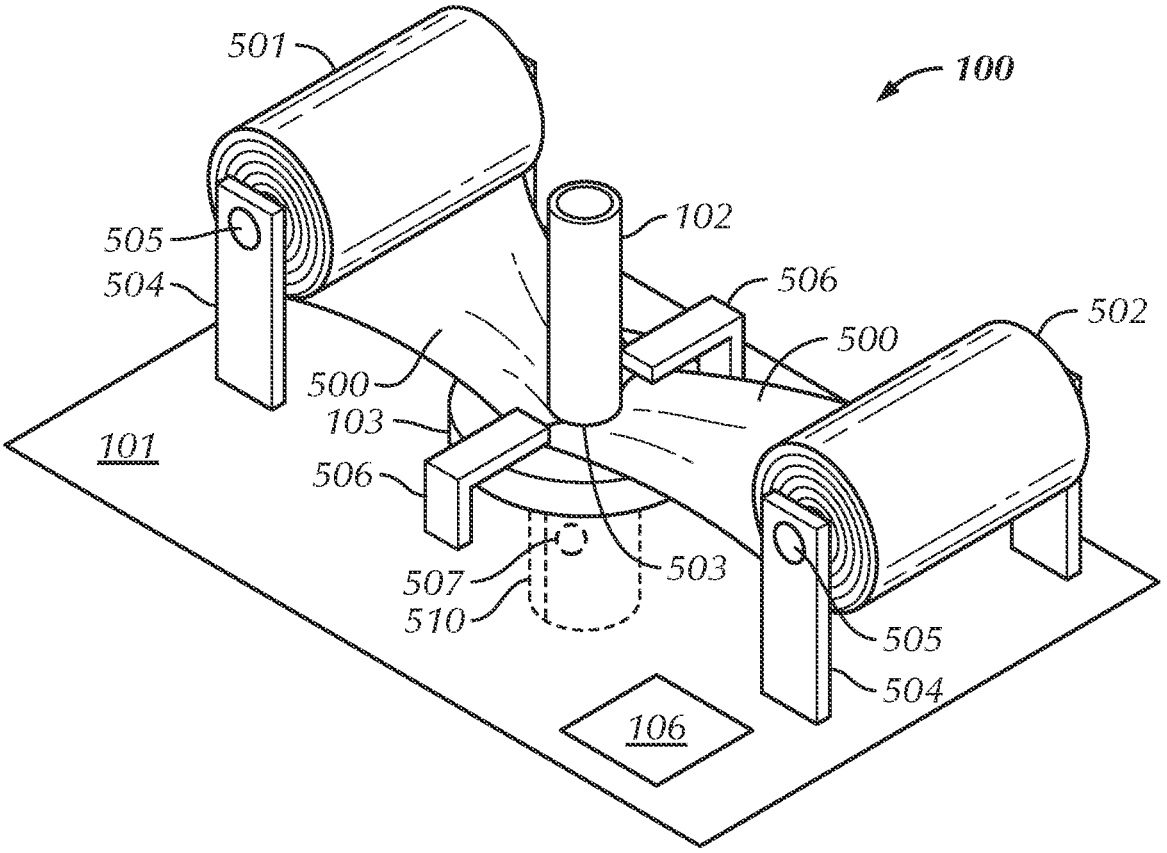
FIG. 5A illustrates a perspective view of a rig floor according to one or more embodiments of the present disclosure.
Figure 5B:
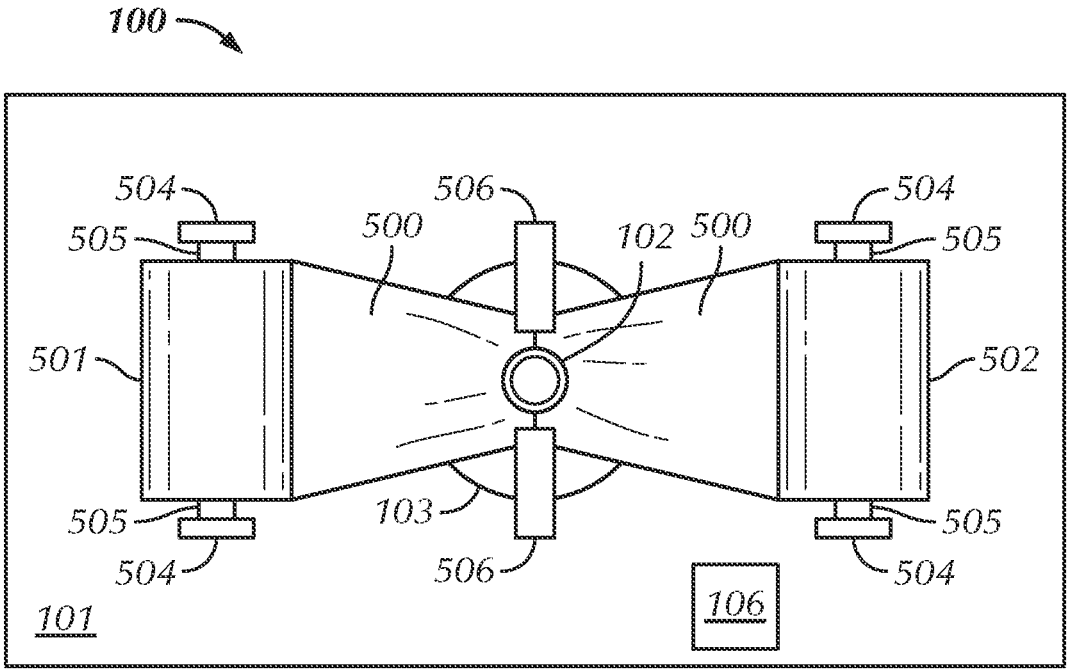
FIG. 5B illustrates a top view of FIG. 5A according to one or more embodiments of the present disclosure.
Figure 5C:
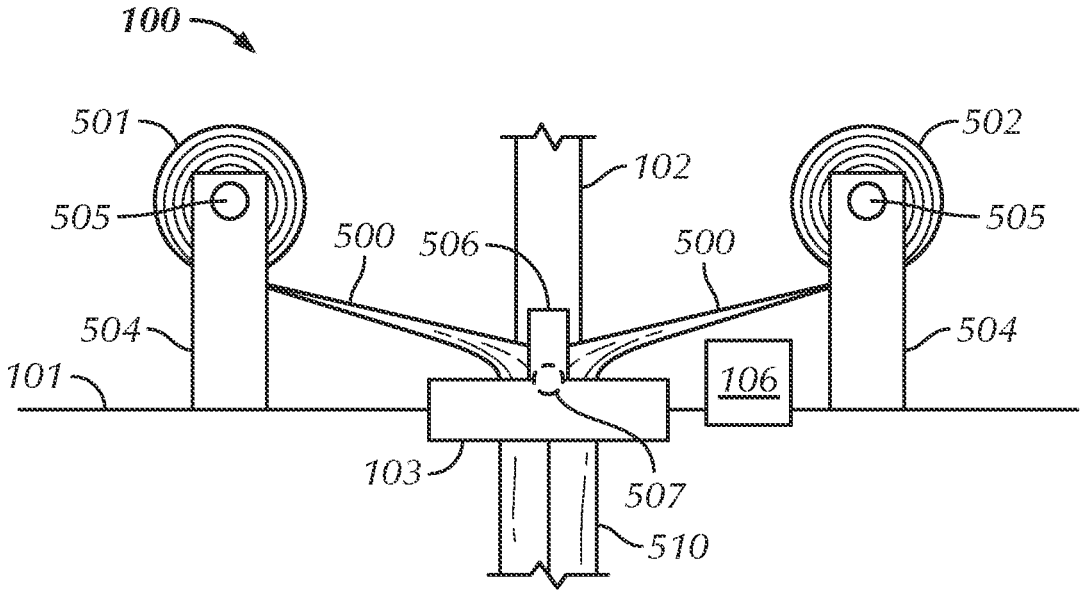
FIG. 5C illustrates a side view of FIG. 5A according to one or more embodiments of the present disclosure.

FIGS. 5A-5C, in one or more embodiments, illustrate a rig site 100 (land or offshore). FIG. 5A is a perspective view of the rig site 100 is illustrated according to one or more embodiments of the present disclosure. FIG. 5B is a top view of FIG. 5A. FIG. 5C is a side view of FIG. 5A. The rig site 100 may include various equipment. For example purposes only, equipment such as mud tanks, mud pumps, a derrick or mast, drawworks, a power generation equipment and auxiliary equipment, and additional components are not shown to avoid clutter in drawings. Additionally, some of the equipment is on a rig floor 101 at the rig site 100. However, one skilled in the art would understand the present disclosure is not limited to just the various rig equipment shown in FIG. 5A without departing the present scope of the disclosure.

A casing string 102 is RIH by having casing joints picked-up individually, connected together, and lowered into the wellbore. For example, the casing joints are made-up end-to-end together at the rig floor 101 via a top-drive system (not shown). For example, a casing joint is set on slips of a rotary table 103, while the next casing joint is rotated above the rotary table 103 to be made-up with the casing joint set on the slips.

In one or more embodiments, in order to start RIH operations of the casing string 102, a fabric sheet 500 is provided on the rig floor 101. For example, the fabric sheet 500 is rolled into two symmetrical fabric rolls 501, 502 having a pre-cut center hole 503 coaxially above the rotary table 103. Additionally, a frame 504 may extend upward from the rig floor 101 and include a bracket 505 extending parallel to the rig floor 101. The two symmetrical fabric rolls 501, 502 may be provided on and rotate about the bracket 505.

Once RIH operations start, the casing string 102 is run through the fabric sheet 500 at the pre-cut center hole 503. For example, the casing string 102 is lifted to be coaxially above the rotary table 103 and lowered to run through the fabric sheet 500 being feed from the two symmetrical fabric rolls 501, 502. The two symmetrical fabric rolls 501, 502 rotate and unroll the fabric sheet 500 as the casing string 102 is being lowered through the fabric sheet 500. An unrolling speed of the fabric sheet 500 may be controlled by pushing the two symmetrical fabric rolls 501, 502 through with the casing string 102. Additionally, one or more union units 506 are provided on the rotary table 103 to close the fabric sheet 500 around the casing string 102. The one or more union units 506 may be a device to weld, sew, glue, mechanically couple, and other attachment method to surround the casing string 102 with the fabric sheet 500 to form a fabric-nested casing string 510. Further, the one or more union units 506 may include a sensor 507 to confirm a union of the fabric sheet 500 around the casing string 102. The sensor 507 may be mechanical, electrical, magnetic, or optical to confirm the union. It is further envisioned that the one or more union units 506 may also be used to un-join the fabric sheet 500 from the casing string 102 in case an emergency pull-out-of-hole (POOH) is required for any reason.

Once the fabric sheet 500 is fully wrapped around the casing string 102 while RIH, a well-control risk may be created. In particular, any un-wanted kicks will flow from the well behind the casing string 102. Kill fluid pumped through the casing string 102 may be trapped inside the fabric sheet 500 only. As a result, controlling the well may fail. In order to avoid such an issue, the pre-cut center hole 503 is provided in the fabric sheet 500 and connected to a modified float joint (700) of the casing string 102.

In one or more embodiments, a control system 106 may be in communication with the rig site 100. The control system 106 may include hardware and/or software that monitors and/or operates equipment at the rig site 100. For example, the control system 106 may be coupled to the one or more union units 506 and the sensor 507 to control and collect data on the fabric sheet 500 being closed around the casing string 102. In some embodiments, the control system 106 may include a programmable logic controller that may control a feed rate of the fabric sheet 500, valve states, fluid levels, pipe pressures, warning alarms, pressure releases and/or various hardware components throughout the rig site 100. Thus, a programmable logic controller may be a ruggedized computer system with functionality to withstand vibrations, extreme temperatures, wet conditions, and/or dusty conditions, such as those around a refinery or drilling rig.

In some embodiments, the control system 106 includes a distributed control system (DCS). A distributed control system may be a computer system for managing various processes at the rig site 100 using multiple control loops. As such, a distributed control system may include various autonomous controllers (such as remote terminal units) positioned at different locations throughout the rig site 100 to manage operations and monitor processes. Likewise, a distributed control system may include no single centralized computer for managing control loops and other operations. On the other hand, a SCADA system may include a control system that includes functionality for enabling monitoring and issuing of process commands through local control at a facility as well as remote control outside the rig site 100. With respect to an RTU, an RTU may include hardware and/or software, such as a microprocessor, that connects sensors and/or actuators using network connections to perform various processes in the automation system.

Figure 6:
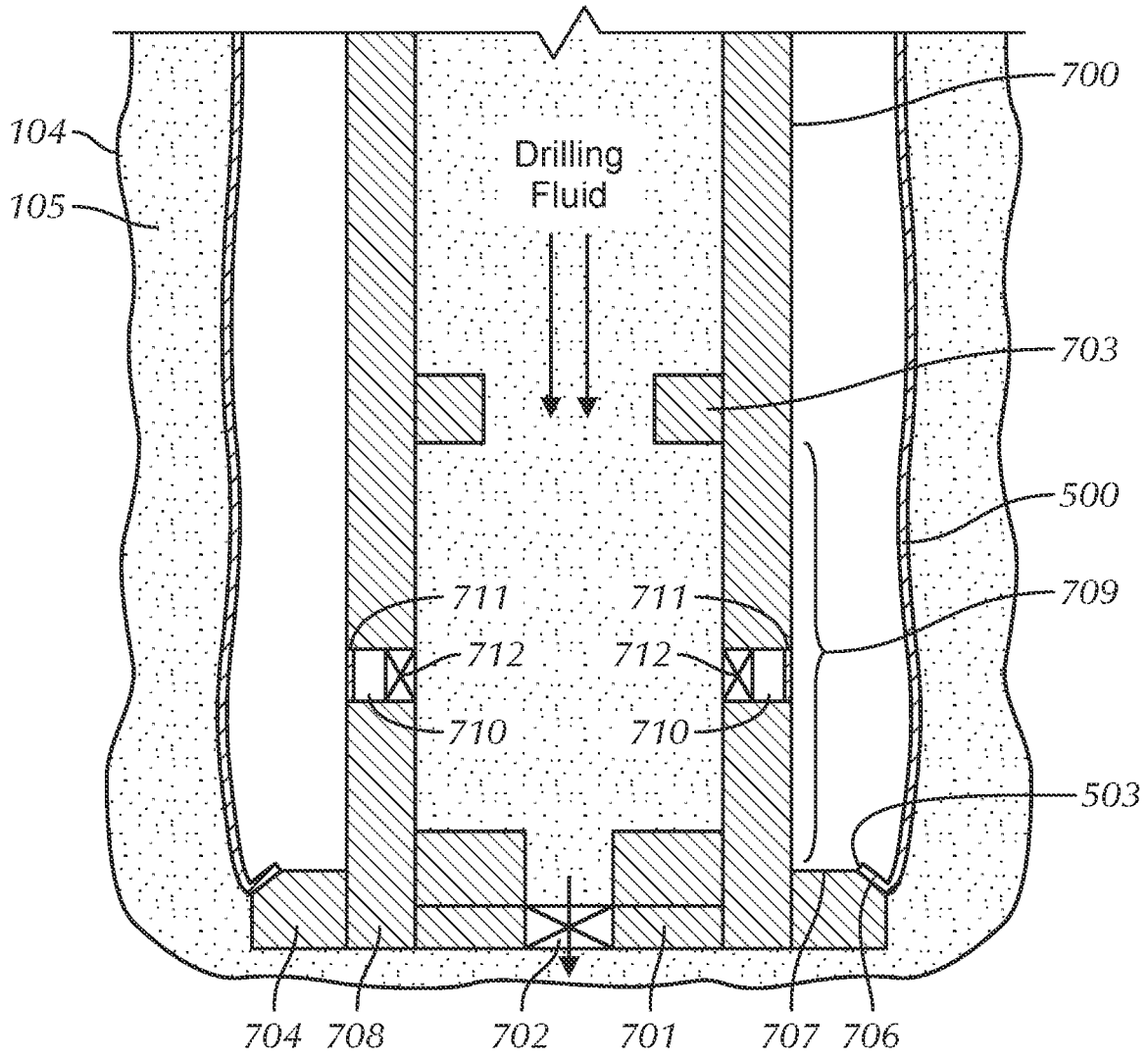
FIG. 6 illustrates a cross-sectional view of a modified float joint according to one or more embodiments of the present disclosure.

As shown by FIG. 6, the modified float joint 700 is a full-sized casing joint at a bottom of the casing string (102) in a wellbore 104. The bottom of the casing string (102) is the lowest depth of the casing string (102) within a wellbore (for example, the first casing joint in the casing string (102)). The pre-cut center hole 503 of the fabric sheet 500 is attached to a sleeve 704 coupled to an outer surface 705 of the modified float joint 700. For example, the sleeve 704 may have a ledge 706 for the pre-cut center hole 503 to be attached to. The ledge 706 may be a slanted surface from a top surface 707 of the sleeve 704.

A float shoe 701 is disposed at a bottom end 708 of the modified float joint 700. A valve 702 in the float shoe 701 prevents reverse flow of cement slurry or wellbore fluids from an annulus 105 into the modified float joint 700 and into the casing string (102) as it is run. The valve 702 may be a check valve, flapper-valve type, a spring-loaded ball valve, or other types of valves to control fluid flow. The float shoe 107 may also guides the casing string (102) toward a center of the wellbore 104 to minimize hitting rock ledges or washouts as the casing string (102) is run. The float shoe 107 may further reduce hook weight. For example, with controlled or partial fill-up as the casing string (102) is run, the casing string (102) can be floated into position, avoiding the need for the rig to carry the entire weight of the casing string (102). Additionally, a float collar 703 is provided within the modified float joint 700 above the float shoe 701. The float collar 703 is used for plugs to land on during the cementing operations.

In one or more embodiments, a space of the modified float joint 700 between the float shoe 701 and the float collar 703 is referred to as a shoe track 709. The shoe track 709 includes one or more side ports 710 to allow for fluid communication between the annulus 105 and the modified float joint 700 above the float shoe 701. The one or more side ports 710 may be initially closed with rupture disks 711. Additionally, a valve 712 is provided in each of the side ports 710 to prevent reverse flow of cement slurry or wellbore fluids from an annulus 105 into the modified float joint 700. The valve 712 may be a check valve, flapper-valve type, a spring-loaded ball valve, or other types of valves to control fluid flow.

Figure 7A:
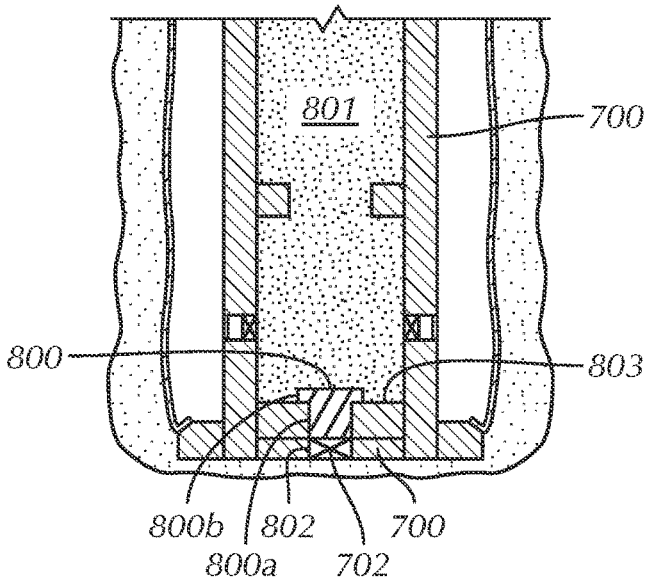
FIGS. 7A-7C illustrated a cross-sectional view of a system using the modified float joint as described in FIG. 6 according to one or more embodiments of the present disclosure.
Figure 7B:
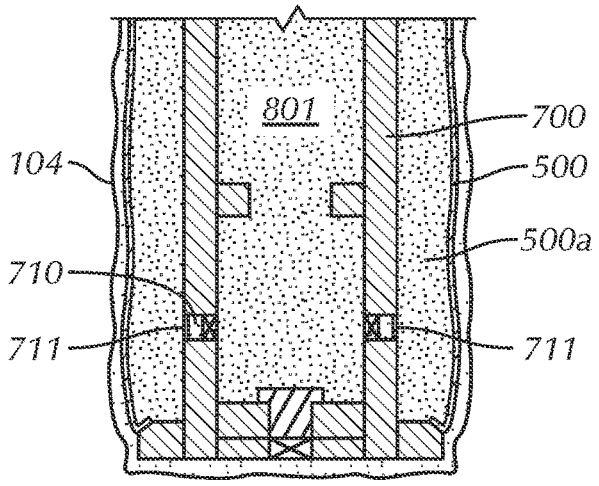
Figure 7C:
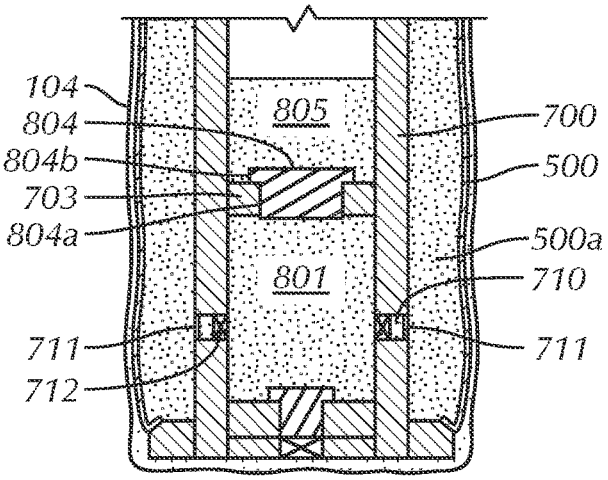

Now referring to FIGS. 7A-7C, in one or more embodiments, FIGS. 7A-7C illustrate a system using the modified float joint 700 as described in FIG. 6 to conduct cementing operations in the wellbore 104 for a nested casing string. As shown in FIG. 7A, in an initial stage, a first plug 800 is pumped ahead of a cement slurry 801 until the first plug 800 lands on the float shoe 701. For example, a lower portion 800*a* of the first plug 800 sets in an opening 802 of the float shoe 701 above the valve 702 and an upper portion 800*b* of the first plug 800 lands on an upper surface 803 of the float shoe 701. With the first plug 800 set, the cement slurry 801 is continuously pumped and a pressure is increased within the modified float joint 700.

As shown in FIG. 7B, once the pressure reaches a threshold, the rupture disks 711 open thereby opening the one or more side ports 710 for fluid flow. The one or more side ports 710 open, the cement slurry 801 then starts inflating the fabric sheet 500 by filling a space 500*a* between the fabric sheet 500 and the casing string (102). The cement slurry 801 will inflate the fabric sheet 500 to cement against the wellbore 104.

As shown in FIG. 7C, with the fabric sheet 500 inflated against the wellbore 104, a second plug 804 is pumped after the cement slurry 801 until the second plug 804 sets on the float collar 703. For example, a lower portion 804*a* of the second plug 804 sits between the float collar 703 and an upper portion 804*b* of the second plug 804 lands on top of the float collar 703. Additionally, some cement slurry 805 is set above the second plug 804. The second plug 804 ensures that no U-tube causes the cement slurry 801 to flow back in the casing string (102) again. Further, the valve 712 within one or more side ports 710 add an additional layer of protection the cement slurry 801 flowing back in the casing string (102) again.

Figure 8:
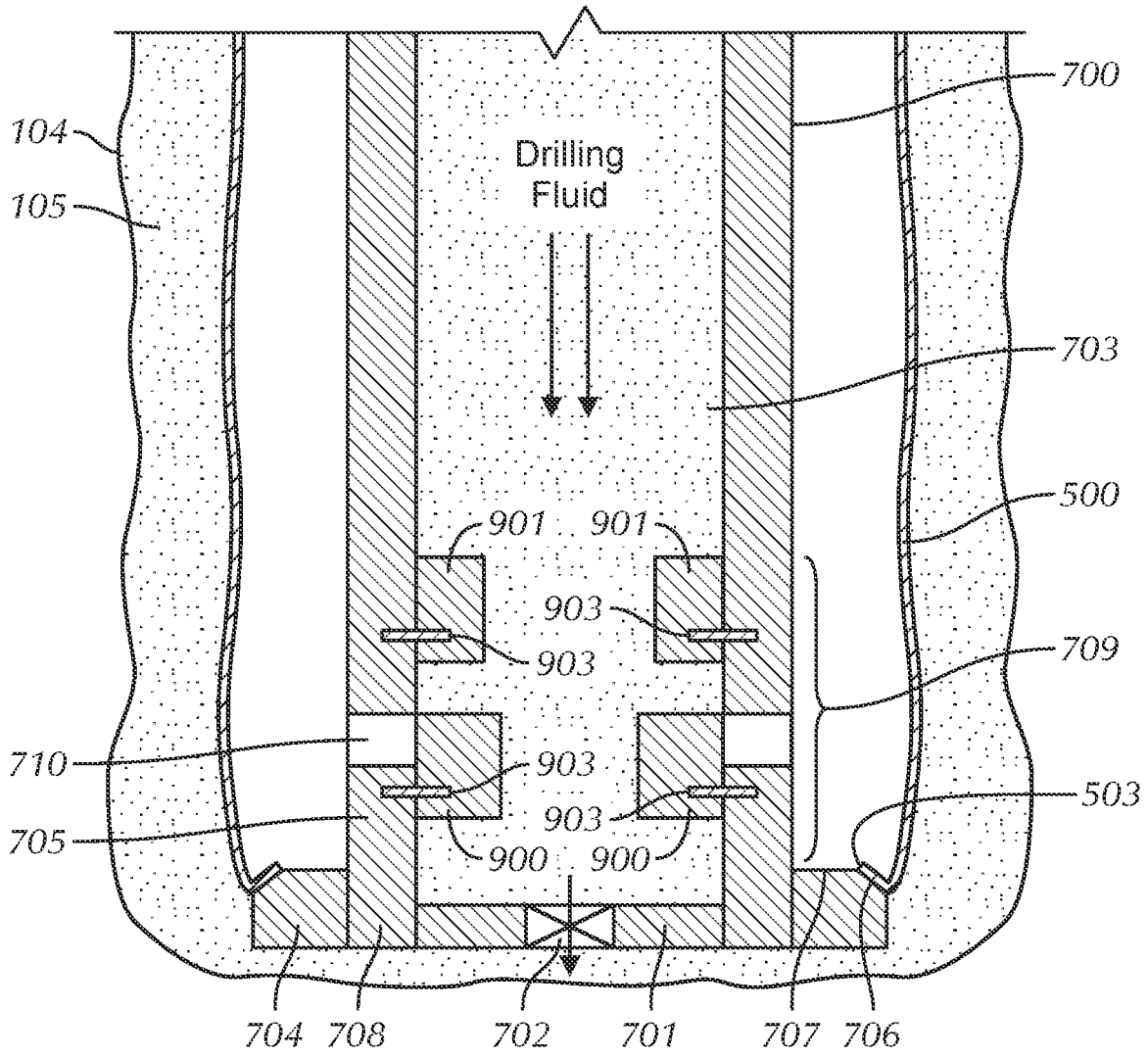
FIG. 8 illustrates a cross-sectional view of a modified float joint according to one or more embodiments of the present disclosure.

Referring now to FIG. 8, another embodiment of the modified float joint 700 as described in FIG. 6 according to embodiments herein is illustrated, where like numerals represent like parts. The embodiment of FIG. 8 is similar to that of the embodiment of FIG. 6. However, instead of having the rupture disks (711) to open the one or more side ports 710, the modified float joint 700 includes a first sleeve 900 to open the one or more side ports 710. Additionally, instead of having the valve (712) to prevent flow back of the cement slurry, the modified float joint 700 includes a second sleeve 901 to close the one or more side ports 710. Additionally, the first sleeve 900 and the second sleeve 901 replace the need for having the float collar (703), and thereby, the space from the sleeves 900, 901 to the float shoe 701 is referred to as the shoe track 709. Furthermore, shear pins 903 are used to actuate the first sleeve 900 and the second sleeve 901.

Figure 9A:
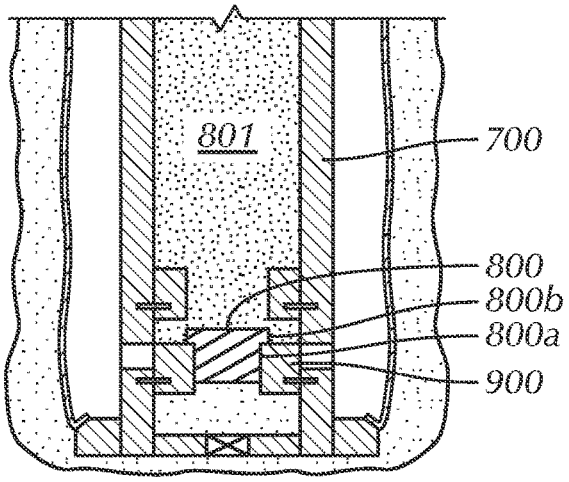
FIGS. 9A-9D illustrated a cross-sectional view of a system using the modified float joint as described in FIG. 10 according to one or more embodiments of the present disclosure.

Now referring to FIGS. 9A-9D, in one or more embodiments, FIGS. 9A-9D illustrated a system using the modified float joint 700 as described in FIG. 8 to conduct cementing operations in the wellbore 104 for a nested casing string. As shown in FIG. 9A, in an initial stage, the first plug 800 is pumped ahead of a cement slurry 801 until the first plug 800 lands on the first sleeve 900. For example, the lower portion 800*a* of the first plug 800 sets in the first sleeve 900 and the upper portion 800*b* of the first plug 800 lands on top of the first sleeve 900. With the first plug 800 set, the cement slurry 801 is continuously pumped and a pressure is increased within the modified float joint 700.

Figure 9B:
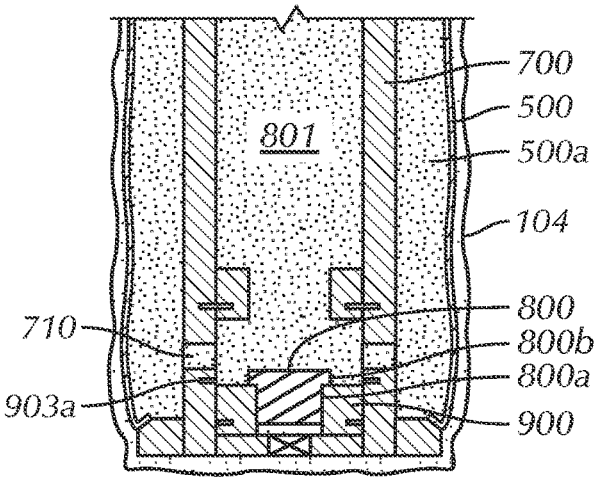

As shown in FIG. 9B, once the pressure reaches a threshold, a first set of shear pins 903*a* shear to axially move the first sleeve 900 downward thereby opening the one or more side ports 710 for fluid flow. The one or more side ports 710 open, the cement slurry 801 then starts inflating the fabric sheet 500 by filling a space 500*a* between the fabric sheet 500 and the casing string (102). The cement slurry 801 inflates the fabric sheet 500 to cement against the wellbore 104.

Figure 9C:
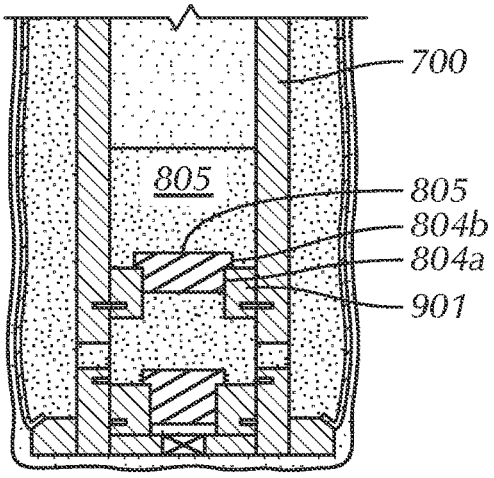

As shown in FIG. 9C, with the fabric sheet 500 inflated against the wellbore 104, the second plug 804 is pumped after the cement slurry 801 until the second plug 804 sets on the second sleeve 901. For example, the lower portion 804*a* of the second plug 804 sets in the second sleeve 901 and the upper portion 804*b* of the second plug 804 lands on top of the second sleeve 901. With the second plug 804 set, more cement slurry 805 is continuously pumped and a pressure is increased on the second plug 804.

Figure 9D:
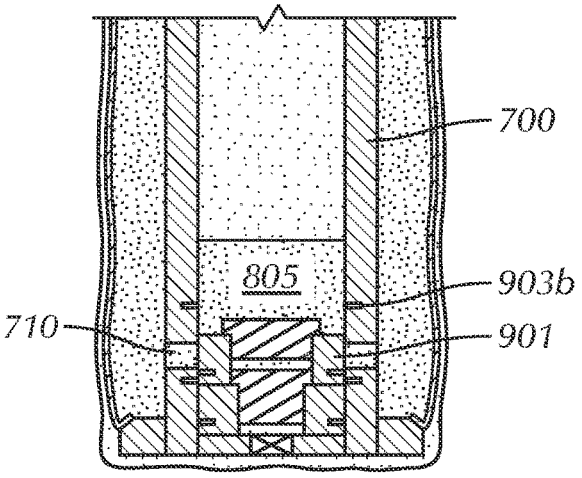

As shown in FIG. 9D, once the pressure on the second plug 804 reaches a threshold, a second set of shear pins 903*b* shear to axially move the second sleeve 901 downward thereby closing the one or more side ports 710, and the cement slurry 801 is enclosed inside the fabric sheet 801. In the closed position, the second sleeve 901 ensures that no U-tube causes the cement slurry 801 to flow back in the casing string (102) again.

Figure 10A:
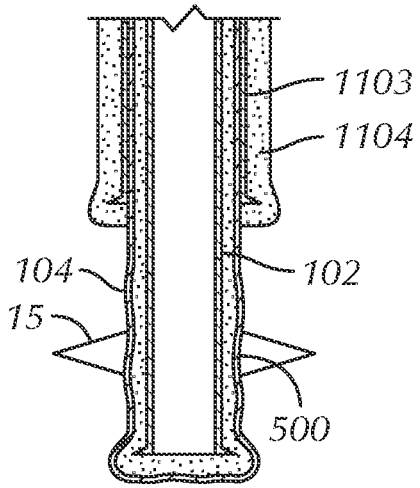
Figure 10C:
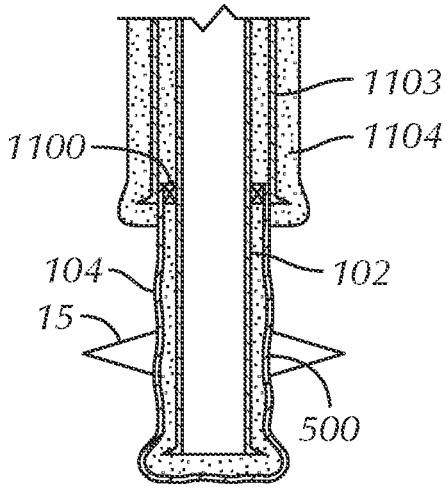
Figure 10C:
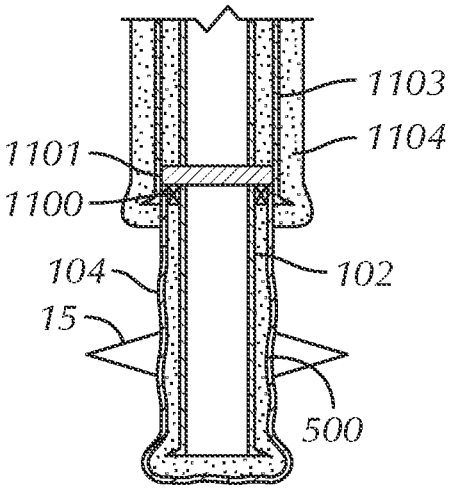

Now referring to FIGS. 10A-10C, a well system using the fabric sheet 500 as described in FIGS. 4-9D to prevent cement loss in the loss-of-circulation zone 15 is shown in accordance with one or more embodiments. A first casing string 1103 extends a first depth within the wellbore 104. The first casing string 1103 is formed from a first plurality of casing joints joined end-to-end. Additionally, a first cement slurry 1104 cements the first casing string 1103 within the wellbore 104. The casing string 102 extends a second depth within the wellbore that is deeper than the first depth.

As shown in FIG. 10A, the fabric sheet 500 may be used to nest a full length of the casing string 102 from a bottom of the wellbore 104 to the surface. In the case of running the fabric sheet 500 to nest the full length of the casing string 102, the fabric sheet 500 is cut when connecting the last casing joint, such as the casing hanger, of the casing string 102. Next, slips of the casing hanger grip the fabric sheet 500 against the walls of the first casing string 1103 holding the fabric sheet 500 at a distal end from a bottom of the wellbore 104. Alternatively, a sleeve may be added to a bottom of the last casing joint for the fabric sheet 500 to attach thereon. It is further envisioned that a welding device may be used to cut the fabric sheet 500.

As shown in FIG. 10B, the fabric sheet 500 may be used to nest a portion of the casing string 102 from a fabric hanger 1100 to a bottom of the wellbore 104. For example, the fabric sheet 500 is cut when connecting the casing joint corresponding to a selected depth based on the portion of the casing string 102 being nested. Additionally, the fabric hanger 1100 may be added to a bottom of the corresponding casing joint for the fabric sheet 500 to attach thereon. Alternatively, slips of the fabric hanger 1100 may grip the fabric sheet 500 against the walls of the first casing string 1103 to hold the fabric sheet 500 in place. In another alternative, a packer of the fabric hanger 1100 may grip the fabric sheet 500 against the walls of the first casing string 1103 to hold the fabric sheet 500 in place.

As shown in FIG. 10C, the fabric sheet 500 may be used to nest a portion of the casing string 102 in a first stage of cementing using a multi-stage cementing tool 1101. The fabric sheet 500 hangs from the fabric hanger 1100 below the multi-stage cementing tool 1101 to the bottom of the wellbore 104. For example, the fabric sheet 500 is cut when connecting the casing joint corresponding to a selected depth based on a depth of the multi-stage cementing tool 1101. Additionally, the fabric hanger 1100 may be added to a bottom of the multi-stage cementing tool 1101 for the fabric sheet 500 to attach thereon. Alternatively, slips of the fabric hanger 1100 may grip the fabric sheet 500 against the walls of the first casing string 1103 to hold the fabric sheet 500 in place. In another alternative, a packer of the fabric hanger 1100 may grip the fabric sheet 500 against the walls of the first casing string 1103 to hold the fabric sheet 500 in place.

Figure 11:
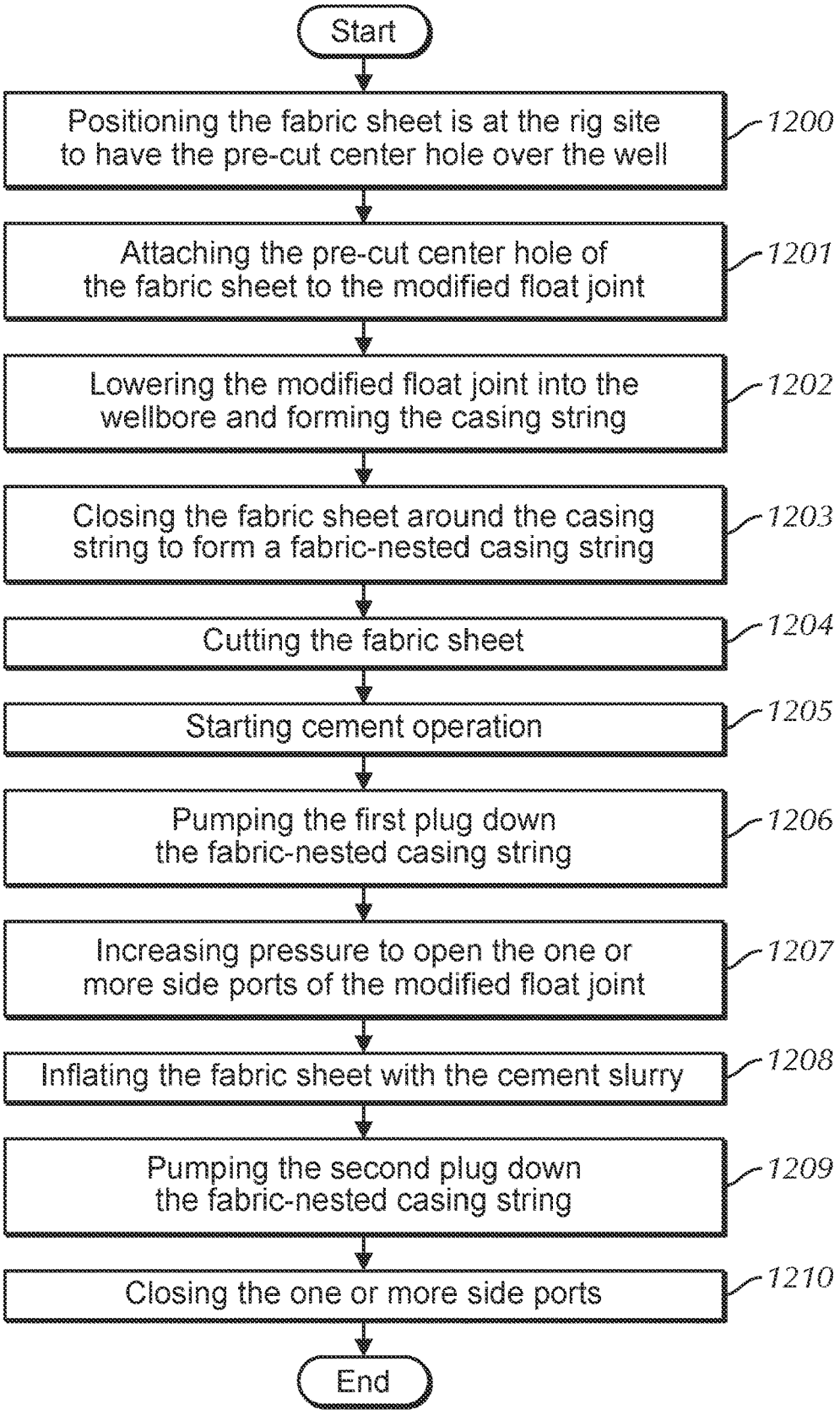
FIG. 11 illustrates a flowchart for utilization of the fabric sheet as described in FIGS. 4-10C according to one or more embodiments of the present disclosure.

FIG. 11 illustrates a flowchart for utilization of the fabric sheet 500 to conduct cementing operations. One or more steps in FIG. 11 may be performed by one or more components (for example, the control system 106 coupled to a controller in communication with the rig site 100) as described in FIGS. 5-10C. For example, a non-transitory computer readable medium may store instructions on a memory coupled to a processor such that the instructions include functionality for operating the fabric sheet 500.

In step 1200, the fabric sheet is positioned at the rig site to have the pre-cut center hole over the well. For example, the rolled fabric sheet is provided on the rig floor in two symmetrical rolls equally spaced from the pre-cut center hole. The pre-cut center hole may be coaxially aligned with the rotary table within the rig floor.

In step 1201, the pre-cut center hole of the fabric sheet is attached to the modified float joint. For example, the pre-cut center hole is attached to the sleeve coupled to the outer surface of the modified float joint. The pre-cut center hole may be attached to the ledge of the sleeve.

In step 1202, the modified float joint is lowered into the wellbore and the casing string is formed. For example, the casing string is run-in-hole (RIH) being having the modified float joint and casing joints picked-up individually, connected together, and lowered into the wellbore. The casing joints are made-up end-to-end together from the modified float joint at the rig floor via the rotary table while RIH. The rotary table provides rotational force to turn the casing joints in a clockwise direction to be made-up end-to-end together.

In step 1203, as the casing string is RIH, the fabric sheet is closed around the casing string to form a fabric-nested casing string. For example, the two symmetrical fabric rolls are rotated and unrolled to feed the fabric sheet into the one or more union units as the casing string RIH. Additionally, the one or more union units mechanically couples the fabric sheet to the casing string. It is further envisioned that a sensor may confirm the union of the fabric sheet around the casing string.

In step 1204, the fabric sheet is cut based on a length of the casing string that is required to be nest. If the fabric sheet is designed to nest a full length of the casing string, the fabric sheet is cut when connecting the last casing joint (for example, uppermost casing joint in the wellbore) of the casing joint. The last casing joint may be the casing hanger of the casing string. For example, slips of the casing hanger grip the cut end of the fabric sheet against the walls of a previous casing string holding the fabric sheet in place at a wellhead. Alternatively, the cut end of the fabric sheet may be attached to the sleeve at the bottom of the last casing joint.

However, if the fabric sheet is designed to only nest a portion of the casing string instead of the full length, the fabric sheet is cut when connecting the casing joint corresponding to a selected depth based on the portion of the casing string being nested. For example, the fabric hanger is added to the corresponding casing joint to hang the fabric sheet. In one embodiment, the cut end of the fabric sheet is attached to the fabric hanger. In another embodiment, the slips of the fabric hanger grip the cut end of the fabric sheet against the walls of the previous casing string to hold the fabric sheet in place. In yet another embodiment, the packer of the fabric hanger grips the cut end of the fabric sheet against the walls of the previous casing string to hold the fabric sheet in place.

In step 1205, once the entire fabric-nested casing string is lowered into the wellbore, cement operations are commenced. For example, the fabric-nested casing string reaches the bottom of wellbore section that was finished drilling.

In step 1206, the first plug is pumped down the fabric-nested casing string ahead of the cement slurry. The first plug is sent downward to until lands on the float shoe of the modified float joint. For example, the lower portion of the first plug sets in the opening of the float shoe above the valve and the upper portion of the first plug lands on the upper surface of the float shoe. Alternatively, the first plug may land on the first sleeve of the modified float joint. For example, the lower portion of the first plug sets in the first sleeve and the upper portion of the first plug lands on top of the first sleeve.

In step 1207, with the first plug set, a pressure is increased within the modified float joint to open the one or more side ports of the modified float joint. For example, the pressure is increased passed by continuously pumping the cement slurry thereby actuating the modified float joint to have the one or more side ports opened. In one example, the pressure reaches a threshold and the rupture disks within the one or more side ports rupture to open the one or more side ports. In another example, the pressure reaches a threshold and the first set of shear pins shear to axially move the first sleeve downward to open the one or more side ports.

In step 1208, with the one or more side ports open, the fabric sheet is inflated with the cement slurry by flowing the cement slurry into the space between the fabric sheet and the casing string. For example, the cement slurry is pumped down the fabric-nested casing string, flow through the one or more side ports, and into the space between the fabric sheet and the modified float joint. The cement slurry will inflate the fabric sheet to cement against the wellbore. The cement slurry may be pumped for a pre-determined time to cement the down the fabric-nested casing string.

In step 1209, the second plug is pumped down the fabric-nested casing string. The second plug is sent downward to until lands on the float collar of the modified float joint. For example, the lower portion of the second plug sets in the float collar and the upper portion of the second plug lands on top of the float collar. Alternatively, the second plug may land on the second sleeve above the first sleeve. For example, the lower portion of the second plug sets in the second sleeve and the upper portion of the second plug lands on top of the second sleeve.

In step 1210, the one or more side ports are closed to stop fluid flow into the fabric sheet. For example, some cement slurry is set above the second plug to ensure that no U-tube causes the cement slurry to flow back in the fabric-nested casing string again. Further, the valve within the one or more side ports may stop a flow back of the cement slurry through the one or more side ports. Alternatively, the cement slurry set above the second plug increase a pressure to shear the second set of shear pins. With the set of shear pins sheared, the second sleeve axially moves downward to close the one or more side ports.

With the one or more side ports closed, the fabric-nested casing string is cemented in place to wellbore and further well operations may be conducted. For example, drilling operations my be conducted to drill the section of the wellbore or a tubing string may be lowered into the fabric-nested casing string to begin hydrocarbon production.

While the method and apparatus have been described with respect to a limited number of embodiments, those skilled in the art, having benefit of this disclosure, will appreciate that other embodiments can be devised which do not depart from the scope as disclosed. Accordingly, the scope should be limited only by the attached claims.

What is claimed is:

1. A rig site, comprising:

a rotary table within a rig floor above a wellbore;

a fabric sheet rolled into two symmetrical rolls disposed on the rig floor, wherein a pre-cut center hole of the fabric sheet is coaxial with the rotary table;

casing joints made-up end-to-end together at the rig floor form a casing string to be lowered in the wellbore, wherein a first casing joint at a bottom of the casing string is a modified float joint, wherein the pre-cut center hole of the fabric sheet is attached to a sleeve of the modified float joint; and one or more union units provided above the rotary table, wherein the one or more union units is configured to close the fabric sheet around the casing string to form a fabric-nested casing string within the wellbore;

wherein a cement slurry is configured to be pumped down the casing string and into a space between the fabric sheet and the casing string to cement the fabric-nested casing string to the wellbore.

2. The rig site of claim 1, wherein the modified float joint further comprising:

a float shoe disposed at a bottom end of the modified float joint;

a float collar is provided within the modified float joint above the float shoe;

one or more side ports provided in a shoe track between the float shoe and the float collar, wherein the one or more side ports allow for the cement slurry to flow into the space; and rupture disks provided in the one or more side ports to close the one or more side ports.

3. The rig site of claim 2, wherein the modified float joint further comprising:

a first plug configured to land on the float shoe and build pressure in the modified float joint to rupture the rupture disks to open the one or more side ports; and a second plug configured to land on the float collar to prevent the cement slurry to flow back in the fabric-nested casing string.

4. The rig site of claim 3, further comprising a valve provided in each of the one or more side ports configured to prevent reverse flow of the cement slurry through the one or more side ports.

5. The rig site of claim 1, wherein the modified float joint further comprising:

a float shoe disposed at a bottom end of the modified float joint;

a first sleeve provided within the modified float joint above the float shoe;

a second sleeve provided within the modified float joint above the first sleeve; and one or more side ports provided in a shoe track above the float shoe and the float collar, wherein the one or more side ports allow for the cement slurry to flow into the space, wherein the first sleeve is configured to open the one or more side ports and the second sleeve is configured to close the one or more side ports.

6. The rig site of claim 5, wherein the modified float joint further comprising:

a first plug configured to land on the first sleeve and build pressure in the modified float joint to shear a first set of shear pins to axially move the first sleeve downward to open the one or more side ports; and a second plug configured to land on the second sleeve and build pressure in the modified float joint to shear a second set of shear pins to axially move the second sleeve downward to close the one or more side ports.

7. The rig site of claim 1, wherein the two symmetrical rolls rotate about a frame on the rig floor to feed the fabric sheet to the one or more union units.

8. The rig site of claim 1, wherein a casing hanger of the fabric-nested casing string is configured to grip the fabric sheet at a distal end from a bottom of the wellbore to nest a full length of the casing string.

9. The rig site of claim 1, further comprising a fabric hanger at a bottom of a corresponding casing joint to attach the fabric sheet to nest a portion of the casing string.

10. A well system, comprising:

a first casing string extending a first depth within a wellbore, wherein the first casing string comprises a first plurality of casing joints joined end-to-end;

a first cement slurry configured to cement the first casing string within the wellbore;

a second casing string extending a second depth within a wellbore, wherein the second casing string comprises a second plurality of casing joints joined end-to-end, wherein the second depth is deeper than the first depth;

a fabric sheet with a pre-cut center hole nesting a length of the second casing string;

one or more union units configured to close said fabric sheet around said second casing string; and a second cement slurry provided in a space between the fabric sheet and the length of the second casing string configured to inflate the fabric sheet against the wellbore and cement the length of the second casing string within the wellbore.

11. The well system of claim 10, wherein the length of the second casing string is nested with the fabric sheet from a surface to a bottom of the wellbore.

12. The well system of claim 11, further comprising a casing hanger to grip the fabric sheet against the first casing string.

13. The well system of claim 10, wherein the length of the second casing string is nested with the fabric sheet from a fabric hanger attached to a casing joint of the second plurality of casing joints to a bottom of the wellbore.

14. The well system of claim 10, wherein the length of the second casing string is nested with the fabric sheet from a multi-stage cementing tool of the second casing string to a bottom of the wellbore.

15. A method, comprising:

attaching a pre-cut center hole of a fabric sheet to a sleeve on a modified float joint of a casing string;

lowering the casing string into a wellbore;

closing, with a union unit, the fabric sheet around the casing string as the casing string is being lowered into the wellbore to form a fabric-nested casing string;

cutting the fabric sheet based on a length of the casing string to be nested by the fabric sheet distal to the modified float joint;

performing cementing operations when the casing string reaches a bottom of the wellbore;

pumping a first plug down the casing string ahead of a cement slurry to land within the modified float joint;

increasing a pressure within the modified float joint by continuously pumping the cement slurry;

opening one or more side ports of the modified float joint when the pressure reached a threshold; and inflating the fabric sheet with the cement slurry by flowing the cement slurry through the one or more side ports into a space between the fabric sheet and the modified float joint, wherein the fabric sheet is inflated against the wellbore to cement the casing string.

16. The method of claim 15, further comprising:

pumping a second plug down the casing string to land within the modified float joint above the first plug; and closing the one or more side ports by setting a second cement slurry above the second plug.

17. The method of claim 15, further comprising rotating two symmetrical fabric rolls to feed the fabric sheet into the one or more union units.

18. The method of claim 15, further comprising attaching a cut end of the fabric end to a fabric hanger on a casing joint of the casing string.

19. The method of claim 15, wherein opening one or more side ports comprises rupturing rupture disks within the one or more side ports.

20. The method of claim 15, wherein opening one or more side ports comprises shearing shear pins to axially move a sleeve of the modified float joint downward unblocking the one or more side ports.

* * * * *